US005921849A

United States Patent [19]

Kim et al.

[11] Patent Number: 5,921,849

[45] Date of Patent: Jul. 13, 1999

[54] METHOD AND APPARATUS FOR DISTRIBUTING A POLISHING AGENT ONTO A POLISHING ELEMENT

[75] Inventors: Inki Kim, Tempe; Lawrence Vondra, Mesa, both of Ariz.

[73] Assignee: Speedfam Corporation, Chandler, Ariz.

[21] Appl. No.: 08/868,878

[22] Filed: Jun. 4, 1997

[51] Int. Cl.[6] ..... B24B 7/22

[52] U.S. Cl. ..... 451/60; 451/41; 451/36; 451/287; 451/446

[58] Field of Search ..... 451/28, 41, 36, 451/60, 285, 287, 288, 446, 453

[56] References Cited

U.S. PATENT DOCUMENTS

| | | | |
|---|---|---|---|
| 3,683,562 | 8/1972 | Day . | |
| 4,490,948 | 1/1985 | Hanstein et al. | 451/446 |
| 5,036,625 | 8/1991 | Gosis . | |
| 5,246,525 | 9/1993 | Sato . | |
| 5,582,540 | 12/1996 | Su et al. . | |
| 5,591,068 | 1/1997 | Taylor . | |
| 5,595,529 | 1/1997 | Cesna et al. . | |
| 5,643,406 | 7/1997 | Shimomura et al. | 451/41 |
| 5,679,063 | 10/1997 | Kimura et al. . | |
| 5,716,264 | 2/1998 | Kimura et al. | 451/41 |
| 5,738,573 | 4/1998 | Yueh | 451/285 |
| 5,755,614 | 5/1998 | Adams et al. | 451/41 |

FOREIGN PATENT DOCUMENTS 0 763 402 3/1997 European Pat. Off. .

OTHER PUBLICATIONS

Patent Abstracts of Japan—vol. 013, No. 143 (M–811), Apr. 7, 1989 and JP 63 306881 (Nippon Mining Co., Ltd.), Dec. 14, 1988.

Patent Abstracts of Japan—vol. 011, No. 225 (M–609), Jul. 22, 1987 and JP 62 039177 (Toshiba Mach Co., Ltd.; Others: 01), Feb. 20, 1987.

Patent Abstracts of Japan—vol. 096, No. 003, Mar. 29, 1996 and JP 07 302774 (Hitachi Cable Ltd.), Nov. 14, 1995.

Patent Abstracts of Japan—vol. 018, No. 383 (M–1640), Jul. 19, 1994 and JP 06 106478 (Kyushu Electron Metal Co., Ltd.; Others: 01), Apr. 19, 1994.

*Primary Examiner*—Eileen P. Morgan
*Attorney, Agent, or Firm*—Snell & Wilmer

[57] ABSTRACT

An apparatus for evenly polishing or planarizing the surfaces of workpieces includes a distributor with a reservoir and a plurality of conduits for uniformly guiding a fluid across a surface of a polishing material. The apparatus is configured to couple to a polishing machine that processes surfaces of workpieces such as semiconductor wafers and computer discs. The reservoir receives a fluid from an exterior source and the fluid is pooled in the reservoir before passing down the conduits to the polishing material. When multiple conduits are employed, the conduits are evenly spaced around the distributor to facilitate uniform application of fluid to a number of locations on the polishing material.

15 Claims, 6 Drawing Sheets

METHOD AND APPARATUS FOR DISTRIBUTING A POLISHING AGENT ONTO A POLISHING ELEMENT

TECHNICAL FIELD

The present invention relates, generally, to apparatus for polishing or planarizing workpieces such as semiconductor wafers and magnetic recording discs, and more particularly, to apparatus for uniformly distributing a fluid across a surface of a polishing material.

BACKGROUND ART AND TECHNICAL PROBLEMS

The production of integrated circuits begins with the creation of high-quality semiconductor wafers. During the wafer fabrication process, the wafers may undergo multiple masking, etching, and dielectric and conductor deposition processes. Because of the high-precision required in the production of these integrated circuits, an extremely flat surface is generally needed on at least one side of the semiconductor wafer to ensure proper accuracy and performance of the microelectronic structures being created at the wafer surface. The need for precise wafer surfaces becomes more important as the size of the integrated circuits decreases and the number of microstructures per integrated circuit increases. Therefore, between some processing steps, it may be necessary to polish or planarize the surface of the wafer to obtain the flattest surface possible.

In an exemplary prior art polishing method, one side of the wafer is attached to a flat surface of a wafer carrier or chuck and the other side of the wafer is pressed against a flat polishing surface. In general, the polishing surface includes a polishing pad. Polishing pads can be formed of various commercially available materials such as a blown polyurethane.

During the polishing or planarization process, the workpiece (e.g., silicon wafer) is typically pressed against the polishing pad surface while the pad rotates about its vertical axis. In addition, to improve the polishing effectiveness, the wafer may also be rotated about its vertical axis and oscillated over the inner and outer radial surface of the polishing pad.

Additionally, in a chemical mechanical planarization ("CMP") process, a slurry, such as, for example, a water-based slurry having colloidal silica particles typically is deposited between the polishing pad and workpiece. CMP processes and apparatus are well known to those skilled in the art; such processes and apparatus will not be described in detail herein. For a more detailed description of CMP processes, see, for example, Arai, et al., U.S. Pat. No. 4,805,348, issued February, 1989; Arai, et al., U.S. Pat. No. 5,099,614, issued March, 1992; Karlsrud et al., U.S. Pat. No. 5,329,732, issued July, 1994; Karlsrud, U.S. Pat. No. 5,498,196, issued March, 1996; and Karlsrud et al., U.S. Pat. No. 5,498,199, issued March, 1996. By this reference, the entire disclosures of the foregoing patents are hereby incorporated herein.

Chemical Mechanical Planarization or Polishing (CMP) occurs when pressure is applied between the polishing pad and the workpiece being polished. The mechanical stresses and the abrasive particles within the slurry creates mechanical strain on the chemical bonds on or near the surface being polished, rendering the chemical bonds more susceptible to chemical attack or corrosion (e.g., stress corrosion). That is, after the mechanical stresses weaken the chemical bonds on the surface, the chemical agent in the slurry will attract certain atoms from the workpiece surface, thus actually removing part of the surface material. Consequently, microscopic regions are removed from the surface being polished, enhancing planarity of the polished surface.

Presently known polishing techniques are unsatisfactory in several regards. For example, during polishing, the polishing agents such as slurry and deionized water may not be deposited evenly over the entire surface of the polishing pad; such uneven polishing agent distribution can result in dry spots on the polishing pad. Consequently, the polishing effect of the pad can be non-uniform across the surface of the workpiece, resulting in a non-planar workpiece surface.

The processing of workpieces may require the deposition of multiple polishing agents from multiple sources. Each source may cause the polishing agents to distribute differently across the surface of the polishing pad. Thus, the polishing rate and uniformity of the polishing rate across the surface of a workpiece may depend on the source from which the polishing agent was dispensed.

Apparatus and methods are thus needed which will uniformly and evenly distribute polishing agents across the surface of the polishing pad and permit a higher degree of planarization and uniformity of material removed over the entire surface of the workpiece.

SUMMARY OF THE INVENTION

The present invention provides methods and apparatus for distribution of polishing agents dispensed from multiple sources over the surface of a polishing material to thereby overcome many of the shortcomings of the prior art, such as uneven and non-uniform workpiece surfaces.

In accordance with one aspect of the present invention, a polishing agent is dispensed onto a fluid distribution apparatus during processing of workpieces.

In accordance with another aspect of the present invention, the fluid distribution apparatus includes a concave portion that allows polishing agents to collect. The collection of polishing agents facilitates uniform distribution of polishing agents dispensed from multiple sources.

In accordance with a further aspect of the present invention, channels are formed within the fluid distribution apparatus to improve fluid distribution across the polishing material during workpiece polishing. During polishing, the polishing agents flow from the concave portion of the fluid distribution apparatus through the channels and onto the polishing material. The channels facilitate the flow of the polishing agents from the concave portion of the fluid distribution apparatus to the polishing material.

BRIEF DESCRIPTION OF THE DRAWING FIGURES

The present invention will hereinafter be described in conjunction with the appended drawing figures, wherein like numerals designate like elements, and:

DETAILED DESCRIPTION OF THE PREFERRED EXEMPLARY EMBODIMENT

The present invention relates generally to an improved fluid distribution apparatus for use in processing workpiece surfaces. Although the workpiece may include virtually any device requiring a controlled finish, the present invention is conveniently described with reference to semiconductor wafers that require controlled and uniform surface finishes. It will be understood by those skilled in the art, however, that the invention is not limited to any particular type of workpiece, polishing material or any particular type of workpiece surface finish.

Figure 1:
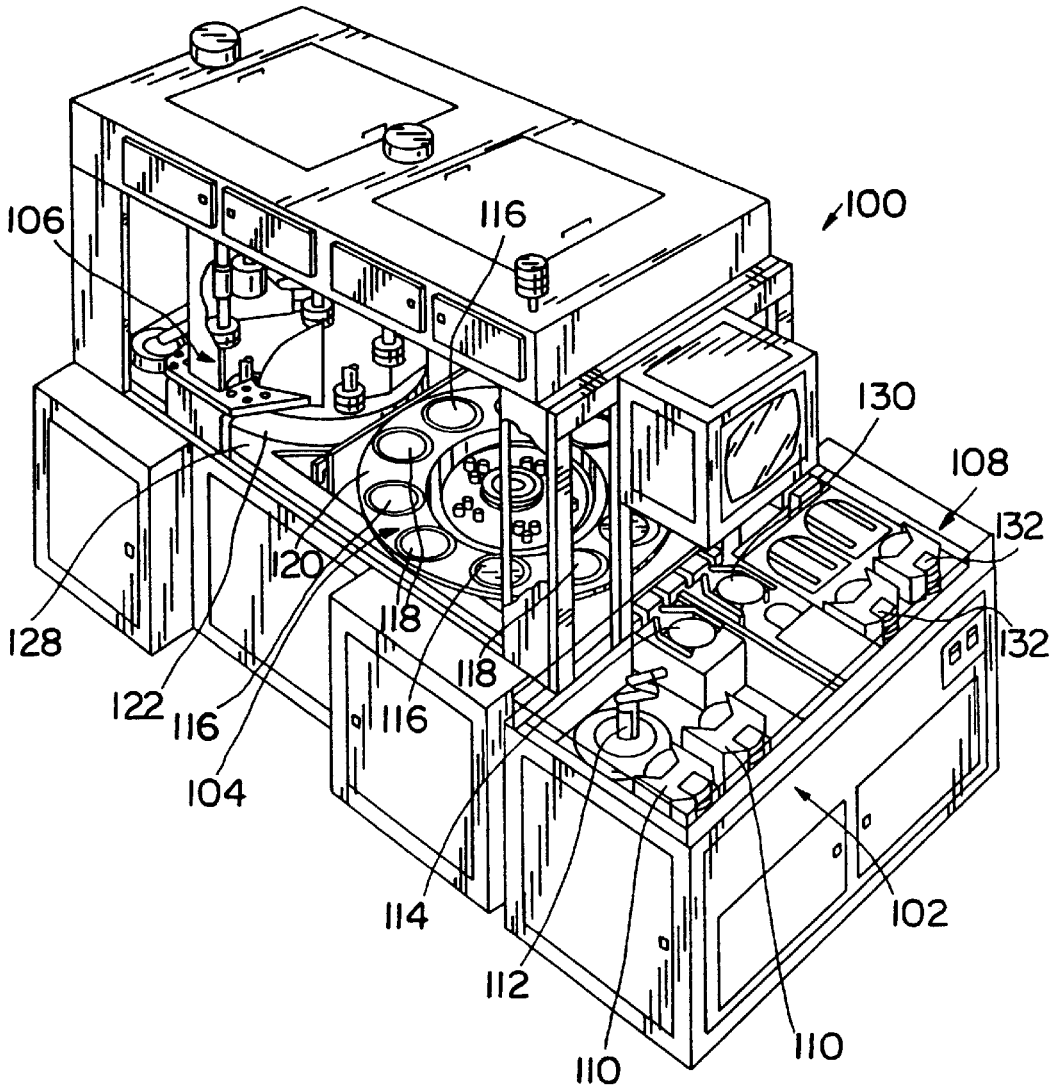
FIG. 1 is a perspective view of a semiconductor wafer polishing and planarization machine in which the present invention may be employed.
Figure 2:
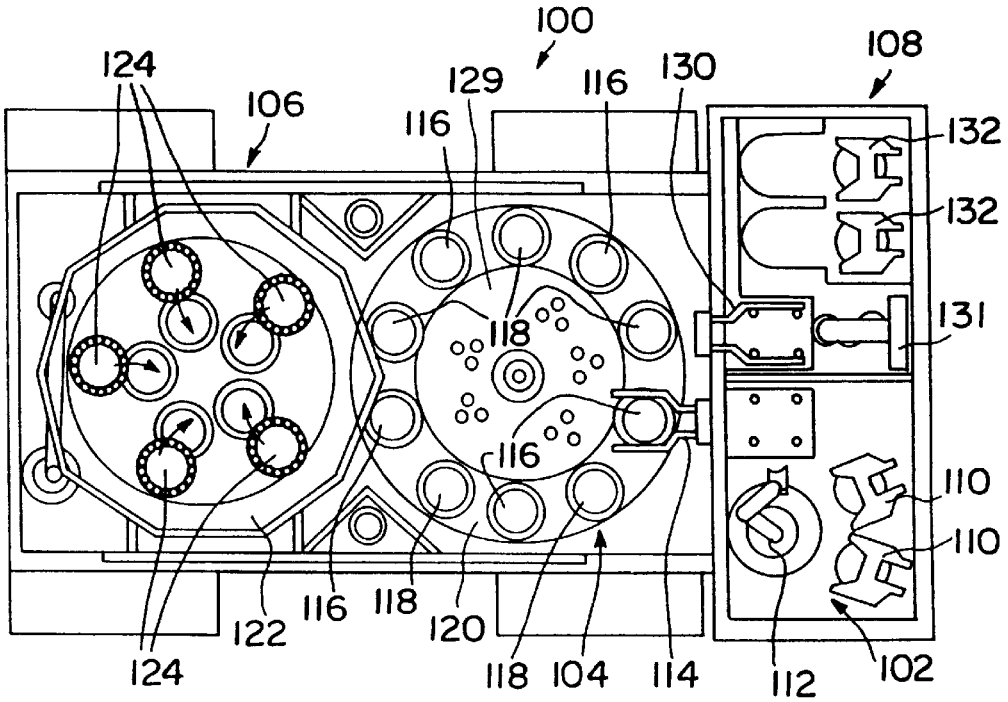
FIG. 2 is a top, cross-sectional view of the machine of FIG. 1 showing a wafer carrying apparatus positioned over a polishing pad.
Figure 3:
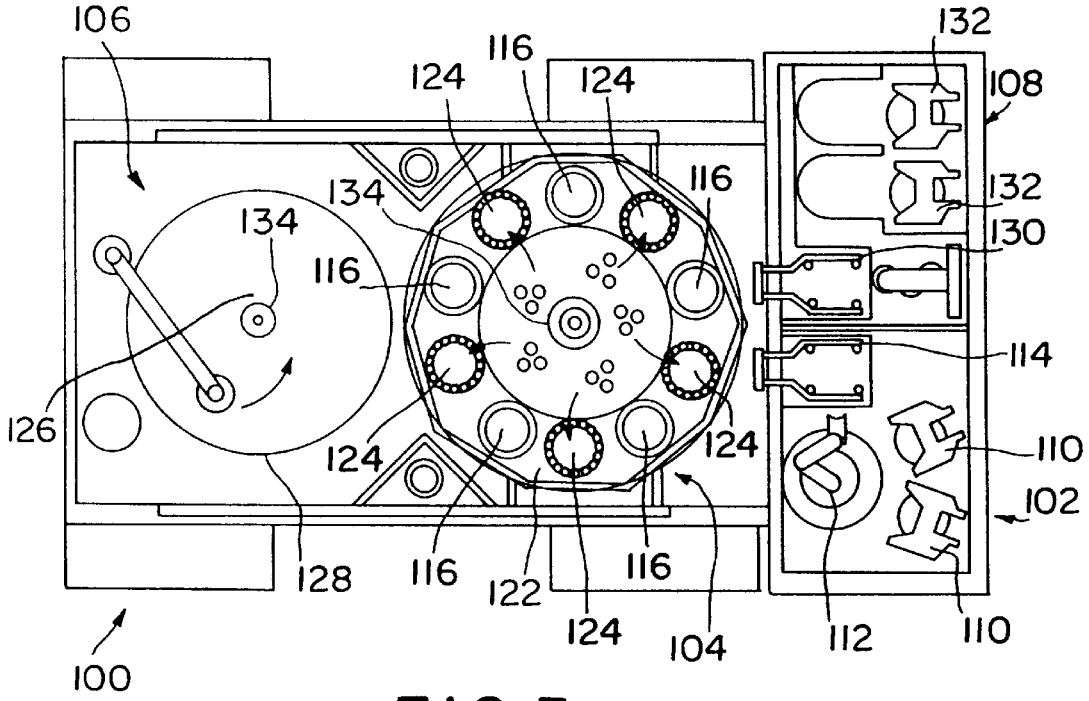
FIG. 3 is another top, cross-sectional view of the machine of FIG. 1 showing the wafer carrying apparatus positioned over a wafer table.
Figure 4:
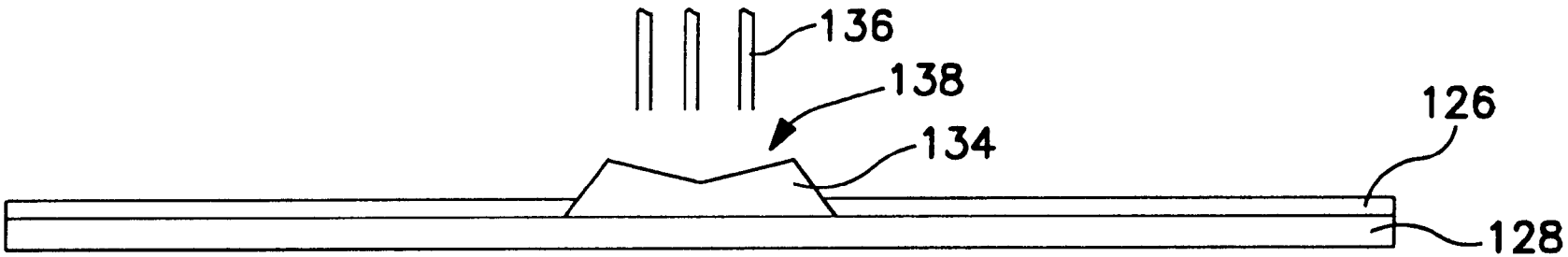
FIG. 4 is a side view of a platen with a fluid distributor in accordance with the present invention.

Referring now to FIGS. 1–3, a wafer polishing apparatus 100 may employ a preferred embodiment of the present invention. Alternatively, the present invention may be utilized in any suitable application that requires a relatively uniform, even, or controlled distribution of fluid over a cooperating component of a surface being processed. Wafer polishing apparatus 100 suitably includes a load station 102, a wafer transition station 104, a polishing station 106, and a wafer rinse and unload station 108. In accordance with a preferred embodiment of the present invention, cassettes 110, each holding a plurality of wafers, are loaded into machine 100 at load station 102. Next, a robotic wafer carrier arm 112 removes the wafers from cassettes 110 and places them, one at a time, on a first wafer transfer arm 114. Wafer transfer arm 114 then lifts and moves the wafer into wafer transition station 104. Wafer transition station 104 may be used to keep the wafers in the presence of deionized water before and after polishing, and it may be used for post polishing cleaning. Transition station 104 may also include a plurality of wafer pick-up stations or load cups 116 which reside on a rotatable index table 120 within wafer transition section 104. Rotatable index table 120 may also suitably include a plurality of wafer drop-off stations or unload cups 118 which alternate with pick-up stations 116. After a wafer is deposited on one of the plurality of pick-up stations 116, index table 120 will rotate so that a new station 116 aligns with transfer arm 114. Transfer arm 114 then places the next wafer on the new empty pickup station 116. This process continues until a desired number of pick-up stations 116 are filled with wafers. In a preferred embodiment of the invention, index table 120 will include five pick-up stations 116 and five drop-off stations 118.

With continued reference to FIGS. 1–3, a wafer carrier apparatus 122, comprising individual wafer carrier elements 124, suitably aligns itself over index table 120 so that respective carrier elements 124 are positioned directly above the wafers which reside in respective pick-up stations 116. The carrier apparatus 122 then drops down and picks up the wafers from their respective stations and moves the wafers laterally such that the wafers are positioned above polishing station 106. Once above polishing station 106, carrier apparatus 122 suitably lowers the wafers, which are held by individual elements 124, into operative engagement with a polishing material 126 which sits atop a primary polishing table or lap wheel 128. During operation, primary lap wheel 128 causes polishing material 126 to rotate about its vertical axis. At the same time, individual carrier elements 124 spin the wafers about their respective vertical axes and oscillate the wafers radially inward and outward across polishing material 126, while the wafers are being pressed against material 126 for polishing and planarizing the surface of the wafer. In addition, a polishing agent is typically deposited onto polishing material 126 during processing. The polishing agent may be any fluid, including deionized water and various slurries. The slurry may be a liquid that chemically reacts with the surface layer of the workpiece to be polished, a liquid containing suspended abrasive particles, or a combination thereof.

With continued reference to FIGS. 1–3, the wafers are removed from polishing material 126 after an appropriate period of time, and carrier apparatus 122 transports the wafers back to transition station 104. Carrier apparatus 122 then lowers individual carrier elements 124 and deposits the wafers onto drop-off stations 118. The wafers are then removed from drop-off stations 118 by a second transfer arm 130. Transfer arm 130 suitably lifts each wafer out of transition station 104 and transfers them into wafer rinse and unload station 108. In unload station 108, transfer arm 130 holds the wafers while they are rinsed by a scrubber 131. After a thorough rinsing, the wafers are reloaded into cassettes 132, which then may be transported to subsequent stations for further processing or packaging.

Polishing apparatus 100 may include a secondary polishing table or lap wheel 129 configured to rotate and perform additional processing of the wafers after processing by primary lap wheel 128. For example, secondary lap wheel 129 may perform final polishing or cleaning of the wafers via a polishing material mounted thereon. It should be appreciated that secondary lap wheel 129 may cooperate with carrier apparatus 122 as described above in connection with primary lap wheel 128.

With reference to FIGS. 2–7, a distributor 134 will be described in detail in accordance with the present invention. In the preferred embodiment of the invention, distributor 134 may be attached to primary lap wheel 128, secondary lap wheel 129, and/or any other suitable processing element of polishing apparatus 100. Using the present invention, a plurality of nozzles 136 can be used to dispense polishing agents such as slurry and deionized water onto distributor 134. Distributor 134 receives polishing agents from nozzle 136 and distributes the polishing agents onto polishing material 126.

Distributor 134 may be made from any material, and preferably from a rigid material. In a preferred embodiment of the present invention, distributor 134 is made from acetal, which is commercially sold under the trade name DELRIN. Distributor 134 is suitably shaped to distribute fluid from multiple sources across a surface. In a preferred embodiment of the invention, distributor 134 includes a substantially frustum-shaped body having a base 135 and an upper portion 137. In the preferred embodiment, a concave reservoir 138 formed within upper portion 137 allows polishing agents to pool within distributor 134 before the polishing agents are distributed onto polishing material 126. When multiple polishing agents are utilized, concave reservoir 138 facilitates mixing of the individual polishing agents prior to distribution. Thus, the polishing agents distributed from dispenser 134 appear to come from a single source, even if they were originally dispensed from multiple nozzles 136. Moreover, different polishing agents may appear to originate from one source (i.e., distributor 134) prior to being distributed across polishing material 126 even if nozzles 136 are located at different locations above distributor 134.

Figure 5:
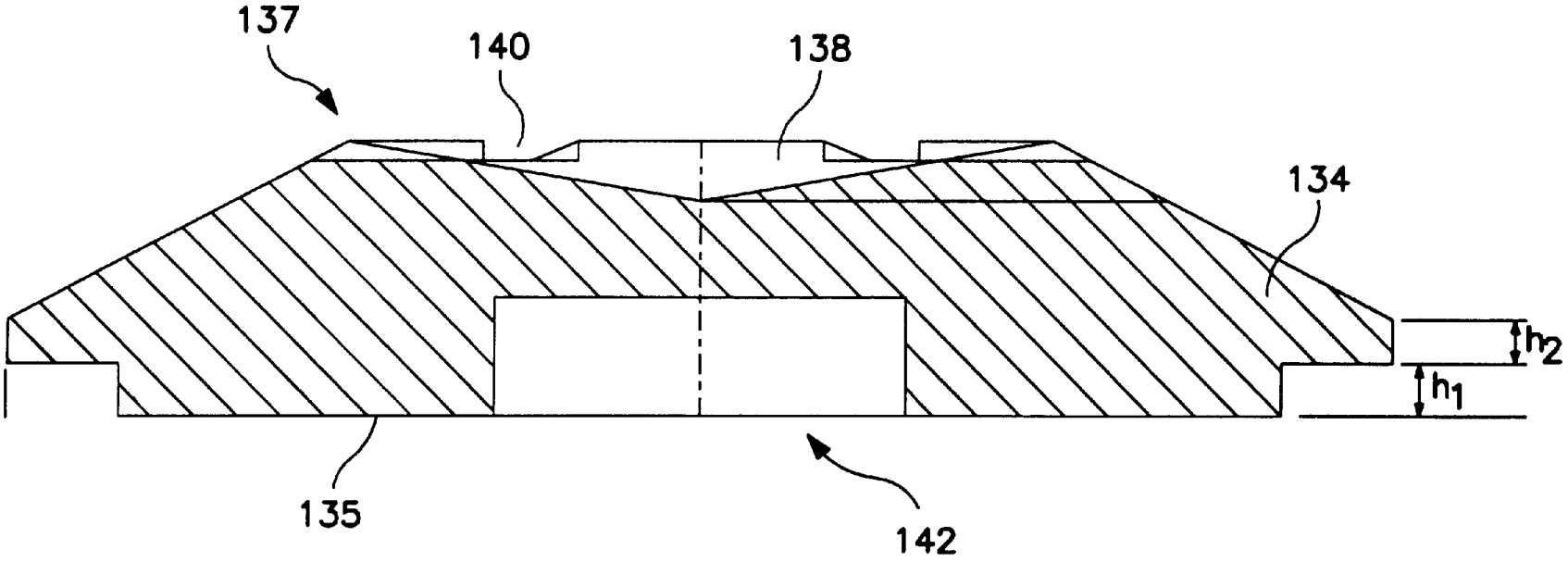
FIG. 5 is a schematic cross-sectional view of the fluid distributor as viewed from line 5—5 shown in FIG. 6.
Figure 6:
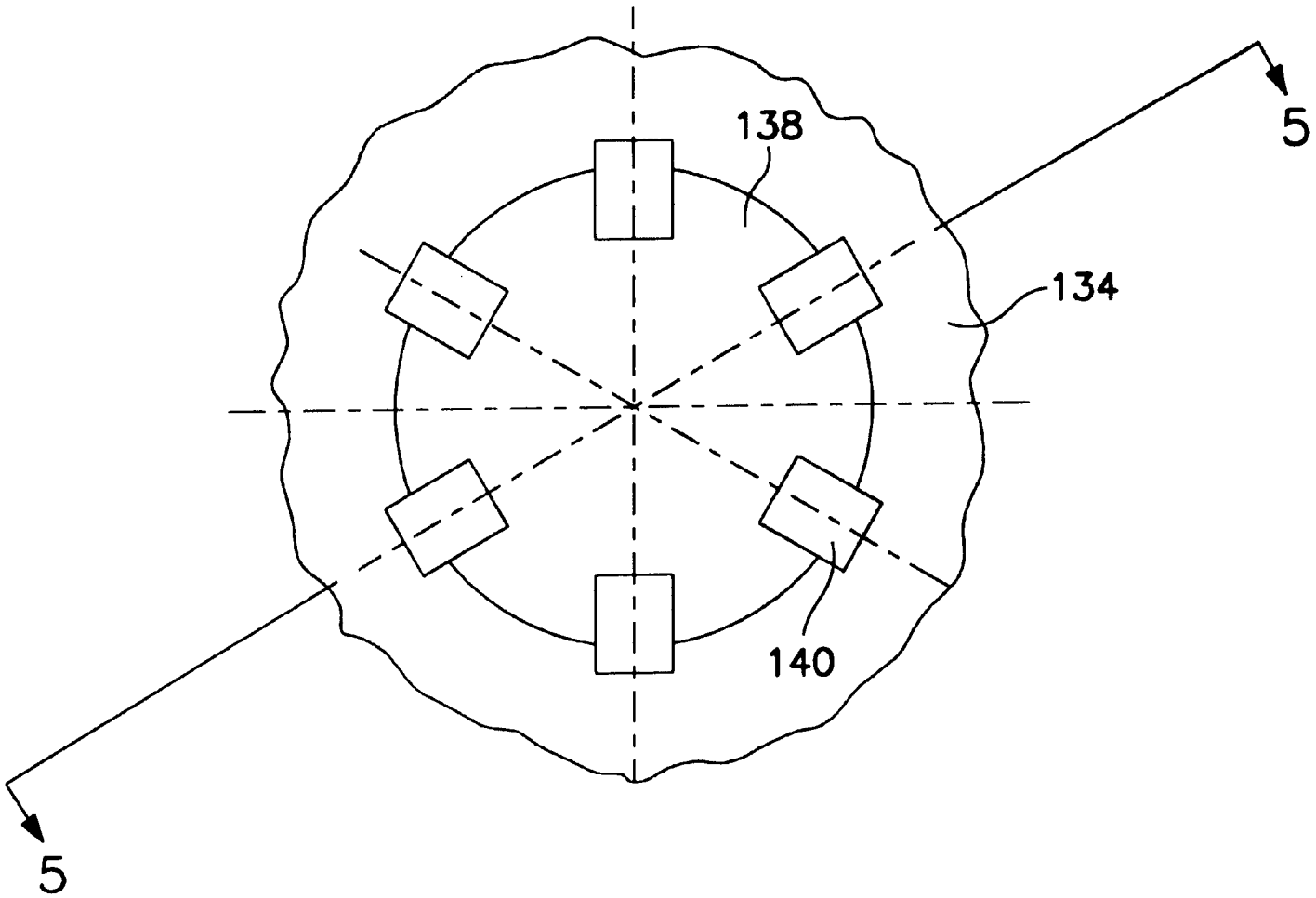
FIG. 6 is a top plan view of the fluid distributor shown in FIG. 5.

Referring now to FIGS. 5 and 6, distributor 134 preferably includes a number of conduits 140 formed therein. In a preferred embodiment, conduits 140 are in fluid communication with concave reservoir 138. Conduits 140 allow fluid in concave reservoir 138 of distributor 134 to be uniformly distributed onto polishing material 126. Although distributor 134 may include any number of conduits 140, in a preferred embodiment of the present invention, distributor 134 includes six conduits 140. In the exemplary embodiment shown in FIG. 6, conduits 140 are substantially evenly spaced apart relative to concave reservoir 138, e.g., positioned symmetrically around the perimeter of concave reservoir 138.

Conduits 140 may be formed in any shape or size. In a preferred embodiment, conduits 140 are rectangular and form trenches within the body of distributor 134. In a preferred embodiment of the invention, the width of each conduit 140 is approximately 6 mm, the length is approximately 12 mm, and the depth is approximately 2 mm. In a further preferred embodiment, the major axis (length) of conduits 140 is along a radius of distributor 134, i.e., conduits 140 extend in a substantially radial direction from concave reservoir 138 to a portion of base 135. The particular size and shape of conduits 140 may be selected to enable a suitable flow rate of the polishing agent, to account for viscosity of the fluid, or in accordance with other parameters associated with the specific application.

Figure 7:
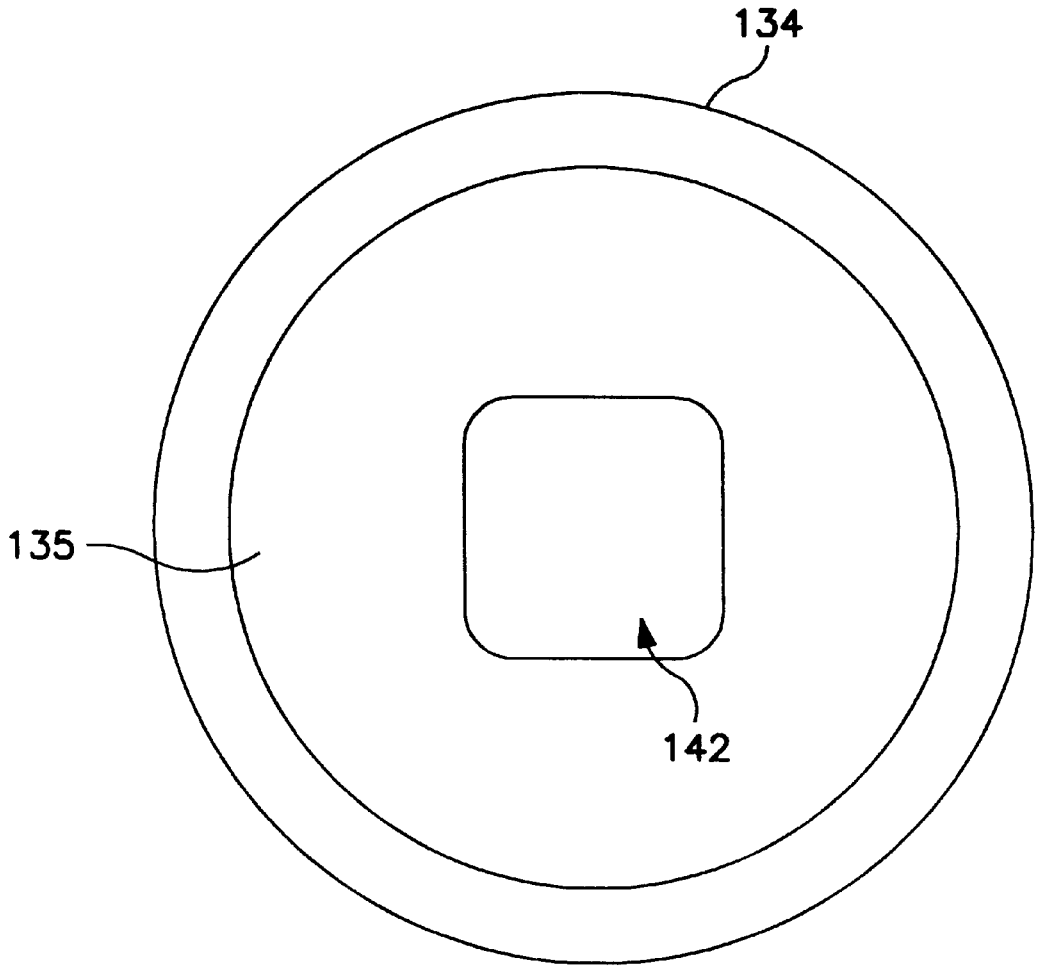
FIG. 7 is a bottom plan view of the fluid distributor shown in FIG. 5.

Referring now to FIGS. 5 and 7, distributor 134 preferably couples to primary lap wheel 128. Although distributor 134 may be used in conjunction with primary lap wheel 128, secondary lap wheel 129, or both, the operation and configuration of distributor 134 is conveniently described with reference to primary lap wheel 128. In the preferred embodiment of the invention, base 135 includes a concave portion formed therein that couples to a convex portion (not shown) of primary lap wheel 128. Concave portion 142 may be configured in a variety of shapes. In the preferred embodiment of the present invention, concave portion 142 is configured as a notch having a square cross section. In an exemplary embodiment, concave portion 142 is approximately 45 mm×45 mm and has a depth of approximately 13 mm. This exemplary configuration enables distributor 134 to suitably engage with primary lap wheel 128. In a preferred embodiment, distributor 134 and primary lap wheel 128 simultaneously rotate about a substantially concentric axis. It should be understood that fluid distributor 134 may be alternatively configured with any suitable attachment element for coupling to primary lap wheel 128 or any cooperating component of polishing apparatus 100, e.g., secondary lap wheel 129.

In a preferred embodiment of the present invention, distribution of the polishing agents is enhanced by the rotation of distributor 134. The polishing agents are urged outward through conduits 140 by centrifugal force as distributor 134 rotates about an axis. In a preferred embodiment of the present invention, as the polishing agents flow outward relative to concave reservoir 138, the polishing agent moves through conduits 140, onto the body of distributor 134, and across the surface of polishing material 126.

As shown in FIG. 5, base 135 is preferably in contact with the surface of polishing material 126, and the outer edge of distributor 134 is preferably raised above the surface of polishing material 126 to facilitate easy removal of distributor 134 from primary lap wheel 128. In the exemplary embodiment shown, the outer edge of distributor 134 is located approximately 6 mm above the surface of polishing material 126 ($h_1$), and the outer edge has a height of approximately 4 mm ($h_2$) The configuration of the outer edge of distributor 134 facilitates effective flow of slurry onto polishing material 126.

Although the present invention is set forth herein in the context of the appended drawing figures, it should be appreciated that the invention is not limited to the specific forms shown. Various other modifications, variations, and enhancements in the design and arrangement of the polishing apparatus as set forth herein may be made without departing from the spirit and scope of the present invention as set forth in the appended claims. For example, while the exemplary invention embodies a device for polishing semiconductor wafers, it should be understood that the invention is not limited to any particular type of workpiece and may be used for such things as polishing of device wafers, hard discs, and glass polishing, at both low and high material removal rates. Also, while the fluid distribution apparatus is described in conjunction with slurries and deionized water, the apparatus may be used to distribute any fluid. In addition, while the preferred embodiment utilizes conduits to transport the slurry to the polishing pad, conduits are not a requirement of the present invention and the distributor may suitably operate by collecting the slurry in the reservoir and distributing the slurry directly therefrom.

What is claimed is:

1. An apparatus for distributing at least one polishing agent across a polishing table having a polishing surface, said apparatus comprising:

a body having a base attached to said table and an upper portion, said upper portion located above said polishing surface;

a concave reservoir formed within said upper portion, said concave reservoir being configured to receive said at least one polishing agent; and means for distributing said at least one polishing agent onto said polishing surface, wherein said means for distributing causes said at least one polishing agent to flow onto said body.

2. The apparatus of claim 1, wherein said body comprises a substantially frustum-shape.

3. The apparatus of claim 1, wherein said means for distributing comprises a plurality of conduits substantially evenly spaced apart relative to said reservoir.

4. The apparatus of claim 1, wherein said means for distributing comprises a conduit in fluid communication with said reservoir, wherein said polishing agent flows from said reservoir into said at least one conduit.

5. The apparatus of claim 4, wherein said conduit comprises a trench formed within said body.

6. The apparatus of claim 4, wherein said conduit extends in a substantially radial direction from said reservoir to a portion of said base.

7. The apparatus of claim 1, further comprising a notch formed within said base, said notch being configured to facilitate removably coupling said base to a portion of a polishing apparatus, allowing said portion to cause said apparatus to rotate about an axis.

8. The apparatus of claim 7, wherein said notch is a substantially square opening.

9. A method for distributing a polishing agent across a polishing table having a polishing surface, said method comprising the steps of:

ejecting a first polishing agent from a first source;

collecting said first Polishing agent in a reservoir formed within a body, said body being coupled to said polishing table, wherein a portion of said body is located above said polishing surface; and distributing said first polishing agent from said reservoir across said polishing surface.

10. The method of claim 9, wherein said first polishing agent is distributed through at least one conduit formed within said body, said at least one conduit being in fluid communication with said reservoir.

11. The method of claim 10, wherein said polishing agent is distributed from substantially evenly spaced-apart locations relative to said body.

12. The method of claim 9, further comprising the steps of:

ejecting a second polishing agent from a second source; and collecting said second polishing agent in said reservoir to thereby form a mixture of said first and second polishing agents, wherein said distributing step distributes a mixture of said first and second polishing agents.

13. An apparatus for distributing at least one polishing agent across a polishing table having a polishing surface, said apparatus comprising:

a body attached to said polishing table, said body having an upper portion, said upper portion located above said polishing surface;

a reservoir formed within said upper portion, said reservoir being configured to receive said at least one polishing agent;

a conduit formed within said body, said conduit in fluid communication with said reservoir; and a means for coupling said apparatus to a polishing device.

14. The apparatus of claim 13, wherein said conduit is configured to allow said polishing agent to flow in a substantially radial direction relative to said body.

15. A method for distributing a polishing agent across a polishing surface, said method comprising the steps of:

receiving at least one polishing agent from a source;

collecting said at least one polishing agent in a reservoir located above said polishing surface and formed within a body, said body being coupled to said polishing surface;

rotating said body and said polishing surface together about a substantially common axis of rotation; and distributing said at least one polishing agent from said reservoir, onto a surface of said body, and across said polishing surface, wherein said rotating step enhances outward flow of said polishing agent relative to said body.

* * * * *